United States Patent [19]

Kugler et al.

[11] Patent Number: 4,599,012

[45] Date of Patent: Jul. 8, 1986

[54] SELF-REDRESSING SLALOM POLE

[75] Inventors: Wolfgang Kugler, Karrösten; Wolfgang Ostermann, Reith bei Seefeld, both of Austria

[73] Assignee: IMS-Kunststoffgesellschaft m.b.H., Innsbruck, Austria

[21] Appl. No.: 672,807

[22] Filed: Nov. 19, 1984

[30] Foreign Application Priority Data

Nov. 18, 1983 [AT] Austria ..... 4061/83

[51] Int. Cl.[4] ..... E01F 9/01

[52] U.S. Cl. ..... 404/10; 40/608; 116/63 R; 116/173; 404/6

[58] Field of Search ..... 404/6, 9, 10, 11; 40/608; 52/113, 103; 116/63 R, 173

[56] References Cited

U.S. PATENT DOCUMENTS

| | | | |
|---|---|---|---|
| 1,337,947 | 4/1920 | O'Toole | 40/608 |
| 1,599,066 | 9/1926 | Rushmore | 40/608 |
| 1,661,446 | 3/1928 | Rank et al. | 40/608 |
| 3,279,133 | 10/1966 | De Korte | 404/10 X |
| 3,853,418 | 12/1974 | Druin et al. | 404/10 X |
| 3,987,593 | 10/1976 | Svensson | 404/10 X |
| 4,061,435 | 12/1977 | Schmanski et al. | 404/10 |
| 4,092,081 | 5/1978 | Schmanski | 404/10 |
| 4,245,922 | 1/1981 | Auriemma | 404/10 |
| 4,270,873 | 6/1981 | Laehy et al. | 404/10 |
| 4,511,281 | 4/1985 | Schmanski | 404/10 |

*Primary Examiner*—Stephen J. Novosad
*Assistant Examiner*—John F. Letchford
*Attorney, Agent, or Firm*—Pahl, Lorusso & Loud

[57] ABSTRACT

Adjustable slalom pole, consisting of a standpipe, a ground part to be inserted into the ground and a tipping element arranged between ground part and standpipe. The standpipe consists of fiber-reinforced synthetic material. This wall strength of the standpipe consists of fiber-reinforced synthetic material. The wall strength of the standpipe tapers off from bottom to top preferably step-wise.

8 Claims, 7 Drawing Figures

SELF-REDRESSING SLALOM POLE

BACKGROUND OF THE INVENTION

The invention concerns an adjustable slalom pole, which consists of a standpipe, a ground part to be inserted in the ground and a tipping element to be arranged between the standpipe and the ground part.

In the adjustable slalom poles customarily being used today in the alpine skiing sport, the standpipe, found over the tipping point or the tipping zone, is made of thermoplastic synthetic material, and that is with generally the same diameter inside and outside. When the ski racer runs into such a slalom pole at high speeds and brushes away the pole with the knee, arm or hand or according to the newest slalom technique, with the leg of the boot or the lower thigh, then he experiences not only a more or less painful blow, but also the slalom pole behaves like a whip and irritates or even endangers the ski racer. The "whip effect" is a result of the very high speed at the time of contact of the racer. Due to forces or inertia which are essentially caused by the mass of the standpipe, the tip of the standpipe is impelled back shortly after the impact of the racer. The whip effect is especially typical for adjustable poles in which the course of bending moment from ground part to standpipe through the tipping zone is interrupted. Despite the whip effect, adjustable poles have been successful for slalom racing because a slalom pole without a tipping zone has other disadvantages, such as a greater strike effect on the racer and an easier pulling out of the ground anchoring.

It is the task of the invention to create an adjustable slalom pole in which the whip effect typical for adjustable slalom poles does not exceed a certain amount and at the same time meets the stresses to which an adjustable pole and its standpipe are subjected.

This task is solved, according to the invention, by making the standpipe of fiber-reinforced synthetic material.

The basis for the invention is the realization that the whip effect typical for adjustable poles is less the greater the bending resistance of a standpipe and the smaller its mass is. Due to the higher bending resistance of a standpipe made of fiber-reinforced synthetic material as opposed to a standpipe of thermoplastic synthetic material, a lower whip effect can therefore be attained with the aid of the measure according to the invention. The mass of the standpipe remains low due to the pipe construction, despite the increased bending resistance.

Due to the dependence on mass of "whip effect" it is also useful if the wall strength of the standpipe which consists of fiber-reinforced synthetic material tapers off preferably stepwise from bottom to top.

Experiments have shown that standpipes made of fiber-reinforced synthetic material attain the necessary bending resistance at very low wall strengths. In this case, the critical load is no longer the bending resistance, but the buckling strength of the pipe. The impact of the shier onto the standpipe takes place in an almost point-shaped fashion. In stiff standpipes the stress is very great; the standpipes can be dented and can snap off. It is therefore important to build these standpipes so that they are resistant to buckling. This can be achieved by filling the standpipes with foam or by orientating the reinforcing material with the fiber direction toward the circumference.

Despite the very solidly built slalom poles, it cannot be avoided that standpipes may break during falls for example. For these cases, care must be taken that the danger of injury is held as low as possible. In the case of the adjustable slalom pole according to the invention, this can be achieved advantageously in that at least the outer layer of the reinforcing material of the standpipe consists of such fibers which have a high elongation at fracture and no or low temperature dependence of this elongation at fracture. This is the case, for example, with aramide fibers or polyester fibers. Standpipes built in such a way will only bend off in the case of a break and the upper and lower ends stay together; there are no broken-off standpipes with an open beak point which can injure the skier.

BRIEF DESCRIPTION OF THE DRAWINGS

The invention is more closely explained as follows by means of applications.

DETAILED DESCRIPTION OF THE PREFERRED EMBODIMENT

Figure 1:
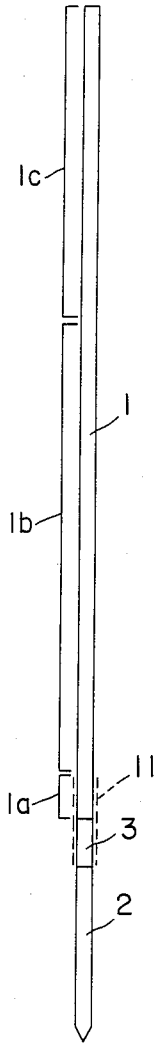
FIG. 1 shows an adjustable slalom pole in overview.

The adustable slalom pole according to FIG. 1 consists of a standpipe 1 made of fiber-reinforced synthetic material, a ground pipe 2 with point and a tipping element 3. The tipping element contains a spring mechanism which causes a slalom pole that has been bent out or knocked over by a skier to right itself automatically.

Figure 2:
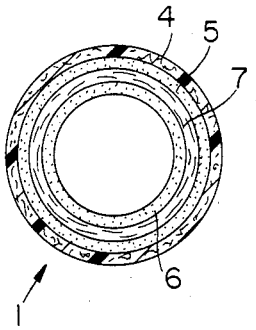
FIG. 2 is a cross-section.
Figure 3:
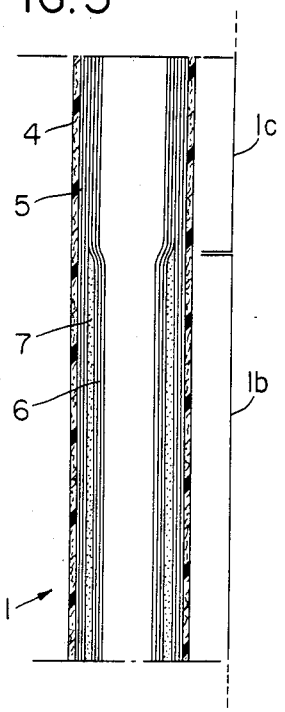
FIG. 3 is a partial longitudinal section of the standpipe.

The standpipe 1, which can be up to 1800 mm in length, has a pipe consisting of several layers or positions, according to FIGS. 2 and 3, that is, an outer layer 4 going through the partial areas 1*a*, 1*b* and 1*c* of the standpipe 1 with a reinforcement of polyester fiber material, as well as two also continuous inner layers 5 and 6 with a reinforcement of glass fiber material oriented primarily along the pipe axis. In the inner layer 5, rovings can be used as reinforcing material, and longitudinally oriented tissues can be used in the inner layer 6. In the two lower partial areas 1*a* and 1*b* of the standpipe 1 there is also an intermediate layer 7 between the two inner layers 5 and 6 which consists of glass fiber material (tissue) that is primarily diagonally oriented to the pipe axis. In the lowest partial area 1*a* there is a further layer (not shown in FIG. 3) with a longitudinally and diagonally oriented glass fiber tissue. The individual layers can each consist of several layers of the appropriate fiber material. The reinforcing material is preferably bonded with epoxy resin.

Due to the higher numbers of layers, the pipe has a higher rigidity in the lower partial areas 1*a* and 1*b* and a higher weight per length unit, which aids the effect according to the invention.

The lowest partial area 1*a* is 200 mm, for example, the medium one 1*b* 1100 mm and the highest one 1*c* 500 mm in length. The diameter of the pipe 1 is about 28 to 30 mm, the wall thickness is in a magnitude of 1 mm, in the medium partial area 1*a* it is higher by about 0.2 mm. At the very bottom in the area 1*a* of the standpipe 1, the wall thickness is even higher due to additional layers of reinforcing material, that is, 2.5 mm.

Figure 4:
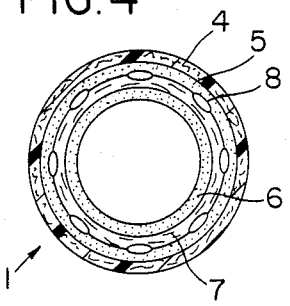
FIG. 4 shows a variant of FIG. 1 in a cross section.

FIG. 4 shows a cross section variant of the standpipe 1, in which, aside from the layers 4 to 7 described in FIGS. 2 and 3, there are also additional rovings 8 on the entire length of the standpipe 1.

Figure 5:
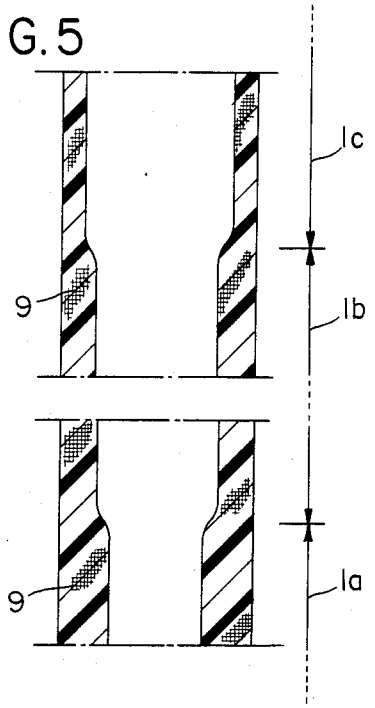
FIG. 5 shows a further application of a standpipe.

In the place of reinforcing material with fiber orientation that differs by layer for differing fiber material, one can also use uniform reinforcing material which is oriented in the same degree in the longitudinal and cross direction, that is, a tissue or weave. The pipe wall 9 shows no succession of layers, as is seen in FIG. 5, but consists in the single areas 1*a*, 1*b* and 1*c* of more or less layers of the same reinforcing material bonded together by epoxy resin, of a polyester weave. The wall thickness are 2.1 mm in area 1*a*, 1.9 mm in area 1*b* and 1.7 mm in area 1*c*. The outer diameter of the standpipe 1 is for example 30 mm. The length of the lower area 1*a* is 800 mm, that the middle area 1*b* is 500 mm and that of the upper area is also 500 mm. The polyester weave layers of the upper area 1*c* also extend over the areas 1*b* and 1*c* and the additional layers of the middle area 1*b* extend over the lower area which also has one (or more) additional layers of polyester weave.

Figure 8:
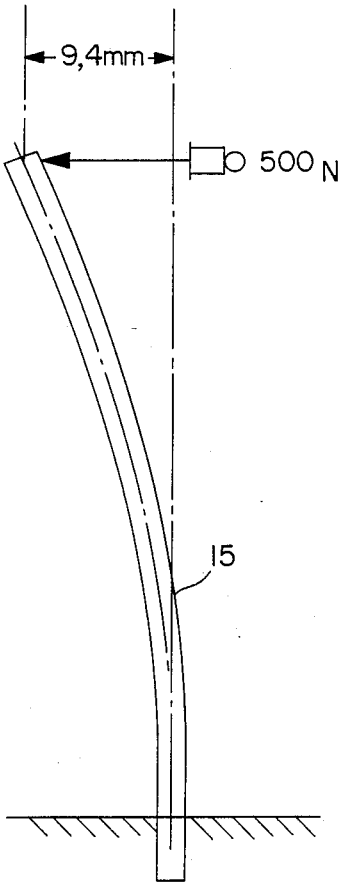
FIG. 8 shows an example of the bending displacement of a prior art slalom pole.

Referring to FIG. 8, an example is provided showing that the bending resistance of a standpipe according to the invention is a multiple of the bending resistance of a customary gate pole made of thermoplast pipe with 4 mm wall thickness. The displacement of a top portion of a standpipe 15 caused by the bending of a standpipe 15 made of thermoplastic synthetic material is 9.4 mm, but that of a standpipe made of reinforced synthetic material according to FIG. 2 is only 2.9 mm (sample 100 mm, fixed in on one side, stress 500 N). The comparative buckling examination showed the following results for a sample of 250 mm length:

standpipe of thermoplast: beginning of buckling 500 N (4 mm wall thickness).

standpipe of reinforced synthetic material (FIG. 3): beginning of buckling 620 N.

Standpipe of reinforced synthetic material (FIG. 4): beginning of buckling 1000 N.

Aside from this, a higher breaking strength of the samples according to the invention was determined (1000 N or 1200 N as against 740 N).

In the area of the point of the standpipe, over a length of 250 to 300 mm. it can be advantageous to elastify the synthetic resin by additives, whereby the point region obtains rubber-like qualities. In this way it is avoided that the pole point shatters when it strikes against the usually hard track surface or against the ski or shoe of the racer when the standpipe is knocked over (FIG. 7).

The standpipes according to the applications according to FIGS. 1 to 5 have each three area of different wall strengths. Of course, one can also use only two or more than three taperings of the wall strength or one can use a continuous decrease of the wall strength from bottom to top. Additionally, the standpipe can be made slightly conic on the outside with a tapering to the top.

The area of the tipping element 3 (tipping zone) can be protected by a protection added on the outside of the adjustable slalom pole in the form of a sleeve 11 (FIG. 1) (not shown), preferrably of flexible synthetic material. The sleeve can also extend into the standpipe 1 a little ways, for example over the length of the lower partial area 1*a* of the standpipe 1.

Figure 6:
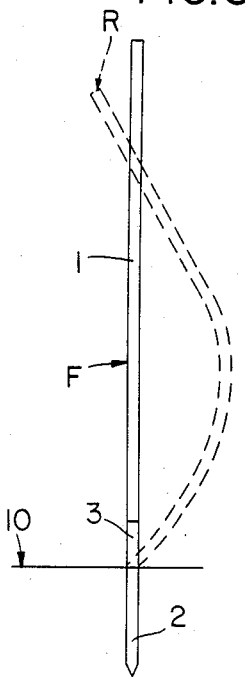
FIG. 6 shows the grounded adjustable slalom pole in order to visualize the whip effect.
Figure 7:
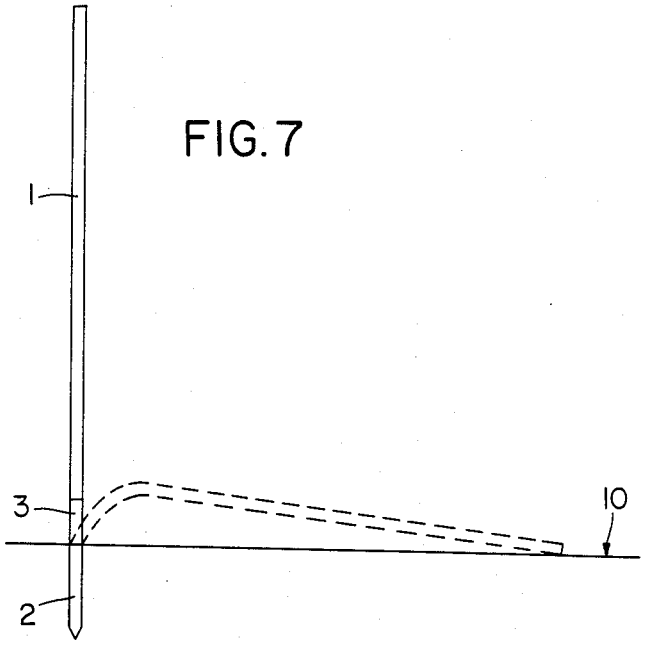
FIG. 7 shows the ground adjustable slalon pole in order to show the outermost tipped postion.

An adjustable slalom pole with the ground part 2 in the ground or the snow is shown in FIGS. 6 and 7. The snow surface is marked with 10. The tipping element 3 is found above the snow surface, the "tipping point" is therefore about on the level of the snow surface 10. FIG. 6 shows the "whip effect" typical for adjustable slalom poles. An impact F by the skier causes a bending back R of the standpipe 1. This bending back R can be held to a minimum by means of the invention. The standpipe 1 strikes with its point onto the (usually icy) snow surface.

What is claimed is:

1. A self-redressing, slalom pole comprising a standpipe, a ground part to be inserted into the ground and a tipping element arranged between the ground part and the standpipe, said standpipe comprising fiber-reinforced synthetic material and having a wall thickness that tapers off in steps from bottom to top, said fiber-reinforced synthetic material being applied in several layers including outer and inner layers, said fiber-reinforced synthetic material including, in at least said outer layer, a synthetic resin fiber construction embedded in a matrix of synthetic resin, said fiber-reinforced synthetic material including threads with an orientation substantially in a longitudinal direction of said standpipe and including, in at least a lower partial area of said standpipe, further threads oriented transverse to the pipe axis.

2. The self-redressing slalom pole according to claim 1 wherein said standpipe includes three partial areas of differing wall thickness, said partial areas tapering off in steps from bottom to top.

3. The self-redressing slalom pole according to claim 1 wherein layers of different reinforcing material are provided.

4. The self-redressing slalom pole according to claim 1 wherein at least two of the layers of said fiber-reinforced synthetic material run through the length of the standpipe.

5. The self-redressing slalom pole according to claim 1 further comprising roving skeins, preferrably made of carbon fibers, additionally descretely distributed in the fiber reinforced synthetic material over the circumference of said standpipe.

6. The self-redressing slalom pole according to claim 1 wherein said standpipe is filled with a foam material.

7. The self-redressing slalom pole according to claim 1 wherein said fiber-reinforced synthetic material comprises polyester fibers.

8. The self-redressing slalom pole according to claim 1 wherein said fiber reinforced synthetic material is embedded in a matrix of epoxy resin.

* * * * *